US009614318B2

(12) United States Patent
Matsumura

(10) Patent No.: US 9,614,318 B2
(45) Date of Patent: Apr. 4, 2017

(54) CONNECTOR AND WIRING HARNESS

(71) Applicant: Sumitomo Wiring Systems, Ltd., Yokkaichi, Mie (JP)

(72) Inventor: Yutaka Matsumura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/027,360

(22) PCT Filed: Oct. 3, 2014

(86) PCT No.: PCT/JP2014/076486
§ 371 (c)(1),
(2) Date: Apr. 5, 2016

(87) PCT Pub. No.: WO2015/060094
PCT Pub. Date: Apr. 30, 2015

(65) Prior Publication Data

US 2016/0254614 A1 Sep. 1, 2016

(30) Foreign Application Priority Data

Oct. 24, 2013 (JP) ..... 2013-221106

(51) Int. Cl.
*H01R 13/58* (2006.01)
*H01R 13/52* (2006.01)

(52) U.S. Cl.
CPC ..... *H01R 13/5841* (2013.01); *H01R 13/5804* (2013.01); *H01R 13/5812* (2013.01); *H01R 13/5205* (2013.01); *H01R 2201/26* (2013.01)

(58) Field of Classification Search
CPC ..... H01R 13/5804; H01R 13/5808; H01R 13/5812; H01R 13/5841; H01R 13/58
See application file for complete search history.

(56) References Cited

U.S. PATENT DOCUMENTS 5,139,431 A * 8/1992 Saitoh ..... H01R 13/6215 439/364
5,234,358 A * 8/1993 Polgar ..... H01R 13/506 439/465

(Continued)

FOREIGN PATENT DOCUMENTS

JP 5-50610 7/1993
JP 9-129307 5/1997

(Continued)

OTHER PUBLICATIONS

International Search Report.

*Primary Examiner* — Ross Gushi
(74) *Attorney, Agent, or Firm* — Gerald E. Hespos; Michael J. Porco; Matthew T. Hespos

(57) ABSTRACT

A connector (C) is formed such that a plurality of terminal insertion holes (12), into which terminals crimped to end parts of wires (40) are inserted, are arranged side by side in a width direction of a terminal insertion surface part (11) on the terminal insertion surface part (11) of a connector housing (10), and includes a plurality of guiding portions (25), (26) and (27) provided side by side in the width direction of the terminal insertion surface part (11) in correspondence with the terminal insertion holes (12). The guiding portions (25), (26) and (27) are configured to guide the wires (40) having the terminals inserted into the terminal insertion holes (12) in a perpendicular direction until the wires (40) are separated from the terminal insertion surface part (11) by specified distances.

2 Claims, 7 Drawing Sheets

(56) References Cited

U.S. PATENT DOCUMENTS 5,315,062 A * 5/1994 Hoshino ..... H01R 13/506 174/72 C
5,453,578 A * 9/1995 Ishii ..... H01R 13/6215 174/138 F
5,731,546 A * 3/1998 Miles ..... H01R 9/2416 174/135
5,788,528 A * 8/1998 Orr, Jr. ..... H01R 13/6275 439/358
5,911,595 A * 6/1999 Orr, Jr. ..... H01R 13/58 439/471
5,925,851 A * 7/1999 Sugahara ..... H01R 13/5208 174/152 G
5,934,939 A 8/1999 Thenaisie et al.
6,036,529 A * 3/2000 Brown ..... H01R 13/518 439/445
6,037,543 A * 3/2000 Nicoli ..... H02G 3/0608 138/157
6,225,557 B1 * 5/2001 Fonteneau ..... H01R 13/506 174/50
6,284,975 B1 * 9/2001 McCord ..... G02B 6/4459 174/481
6,540,547 B2 * 4/2003 Zweigle ..... H01R 13/5804 439/464
7,128,598 B2 * 10/2006 Ebert ..... H01R 13/5812 439/445
7,182,626 B2 * 2/2007 Langolf ..... H01R 13/5213 439/473
7,270,562 B1 * 9/2007 Trout ..... H01R 13/6215 439/364
7,896,668 B2 * 3/2011 Yash ..... H01R 13/506 439/153
9,090,215 B2 * 7/2015 Oiwa ..... B60R 16/0215
9,263,826 B2 * 2/2016 Wu ..... H01R 13/5841
9,401,563 B2 * 7/2016 Simpson ..... H01R 13/5841
2001/0005652 A1 * 6/2001 Brownell ..... H01R 13/516 439/466
2005/0085119 A1 * 4/2005 Schluter ..... H01R 9/2416 439/395
2009/0122976 A1 * 5/2009 Edelmann ..... H01R 9/2416 379/413.04
2015/0162693 A1 * 6/2015 Ng ..... H01R 13/5812 439/586
2015/0349456 A1 * 12/2015 Pegel ..... H01R 13/5845 439/460

FOREIGN PATENT DOCUMENTS

JP 10-83864 3/1998
JP 10-228946 8/1998
JP 2010-282764 12/2010
JP 2011-40264 2/2011
JP 2013-149535 8/2013

* cited by examiner

CONNECTOR AND WIRING HARNESS

BACKGROUND

1. Field of the Invention

The present invention relates to a connector and a wiring harness.

2. Description of the Related Art

A wiring harness laid in an automotive vehicle includes a connector crimped to end parts of wires. Conventionally, a connector is known in which a plurality of terminal accommodating chambers 4, into which terminals crimped to end parts of wires 3 are inserted, are arranged side by side in a width direction of a terminal insertion surface part 2 on the terminal insertion surface part 2 of a connector housing 1, as shown in FIG. 8 herein and in Japanese Unexamined Patent Publication No. 2010-282764.

Further, some connectors include waterproof plugs made of rubber and fit on the end parts of the wires 3 in addition to the above configuration to keep the interiors of the terminal accommodating chambers 4 in a watertight manner by being held in close contact with inner peripheral parts of the terminal accommodating chambers when the wires are inserted into the terminal accommodating chambers 4 of the connector housing 1.

The wires 3 having the terminals inserted into the terminal accommodating chambers 4 are passed through a space enclosed by a U-shaped guide frame 5 provided on one end part of the terminal insertion surface part 2 of the connector housing 1 in the width direction and configured to regulate a wire arrangement direction and the terminal insertion surface part 2, and guided to be laterally extended toward one side (right side) in the width direction of the terminal insertion surface part 2.

The entire lengths of the wires 3 are set such that that of the wire 3 having the terminal inserted into the left one of the plurality of terminal accommodating chambers 4 of the terminal insertion surface part 2 is longer than that of the wire 3 having the terminal inserted into the terminal accommodating chamber 4 on the right side.

However, if the wires 3 of the connector housing 1 are pulled in a direction (left) opposite to an extended direction (right) of the wires 3 in mounting the aforementioned connector housing 1 and wires 3 into an automotive vehicle or the like, a tension acts on the wire 3 having a shortest extra length out of the plurality of wires 3. This tension acts on a terminal crimping portion of the wire 3 in a direction oblique to an axis of the terminal. Thus, the wire 3 may be broken or the waterproof plug may be deformed to be unable to keep the interior of the terminal accommodating chamber 4 in a watertight manner.

Accordingly, the present invention was developed to solve the aforementioned problem and aims to provide a connector and a wiring harness in which no tension is applied to a terminal crimping portion of a wire in a laterally extended state in a direction oblique to an axis of a terminal.

SUMMARY

To achieve the above object, the invention is directed to a connector formed such that a plurality of terminal insertion holes are arranged side by side in a width direction of a terminal insertion surface of a connector housing. Terminals crimped to end parts of wires are inserted into the terminal insertion holes. Guiding portions are provided side by side in the width direction of the terminal insertion surface in correspondence with the terminal insertion holes. Each guiding portion is configured to guide the wire having the terminal inserted into the terminal insertion hole in a perpendicular direction until the wire is separated from the terminal insertion surface by a specified distance.

By this configuration the wires are guided from the terminal insertion surface in the perpendicular direction by the specified distances by the respective guiding portions and, then are extended laterally by parts of the guiding portions corresponding to the respective wires, namely the parts configured to laterally extend the wires. Thus, if the connector housing is pulled in a direction opposite to a laterally extended direction of the wires, a bent part of the wire having a shortest extra length comes into contact with the guiding portion and a tension acting on this wire acts on the terminal insertion surface in the perpendicular direction. Thus, in the connector according to the present invention, no tension is applied to a terminal crimping portion of the wire in the laterally extended state in a direction oblique to an axis of the terminal and the breakage of the wire can be prevented.

In the connector configured as described above, the plurality of guiding portions may be configured so that a distance from the terminal insertion surface part is shorter for the guiding portion closer to a side toward which the wires are laterally extended. By this configuration, the wires laterally extended through the respective guiding portions can be overlapped effortlessly in parallel and laterally extended.

To achieve the above object, the present invention is directed to a wiring harness including the above connector and wires having terminals inserted into the terminal insertion holes of the connector housing. By this configuration if the connector housing is pulled in a direction opposite to a laterally extended direction of the wires, a bent part of the wire having a shortest extra length comes into contact with the guiding portion and a stress acts on the guiding portion. Thus, no tension is applied to a terminal crimping portion of the wire in the laterally extended state in a direction oblique to an axis of the terminal and the breakage of the wire can be prevented.

According to the present invention, it is possible to provide a connector and a wiring harness in which no tension is applied to a terminal crimping portion of a wire in a laterally extended state in a direction oblique to an axis of a terminal.

DETAILED DESCRIPTION

Hereinafter, a connector and a wiring harness according to an embodiment of the invention are described with reference to the drawings.

Figure 1A:
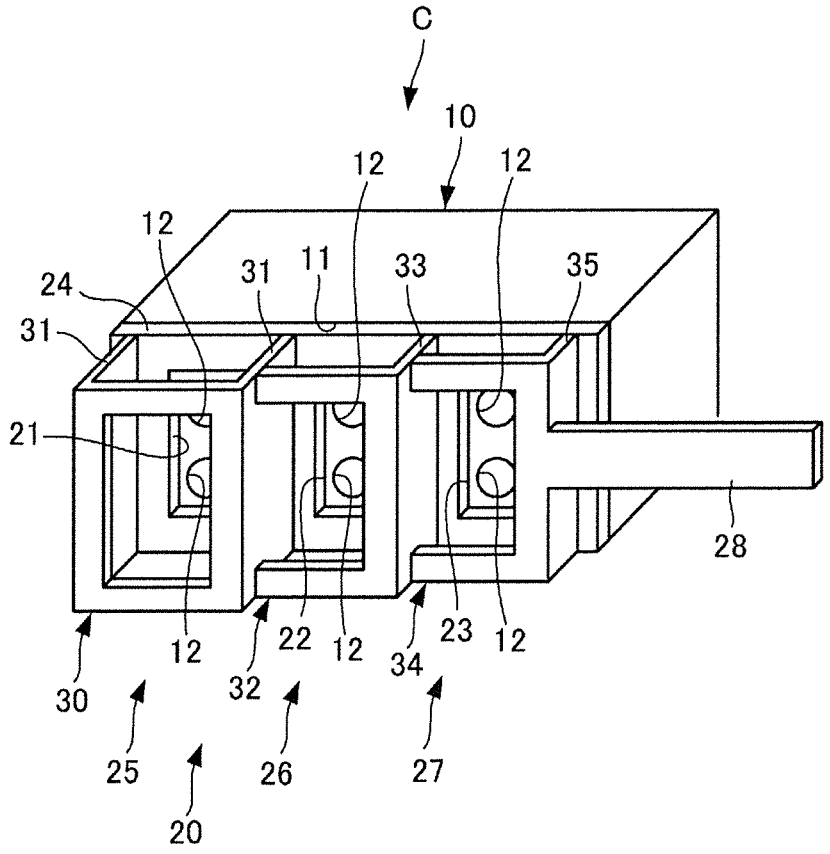
FIG. 1A is a schematic perspective view of a connector according to an embodiment of the present invention.
Figure 1B:
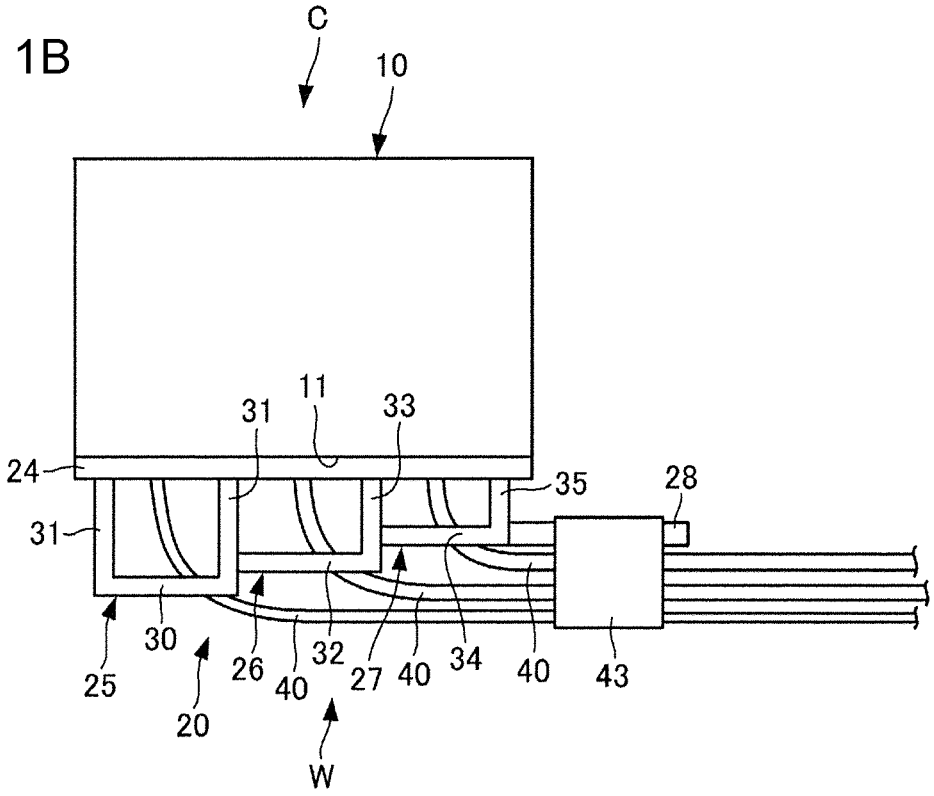
FIG. 1B is a schematic plan view of a wiring harness according to the embodiment of the present invention.

As shown in FIGS. 1A and 1B, a connector C according to this embodiment includes a connector housing 10 and a wire guide 20 and constitutes a wiring harness W to be laid in an automotive vehicle or the like. However, the use of the connector and the wiring harness according to the invention is not limited to automotive vehicles.

Figure 2:
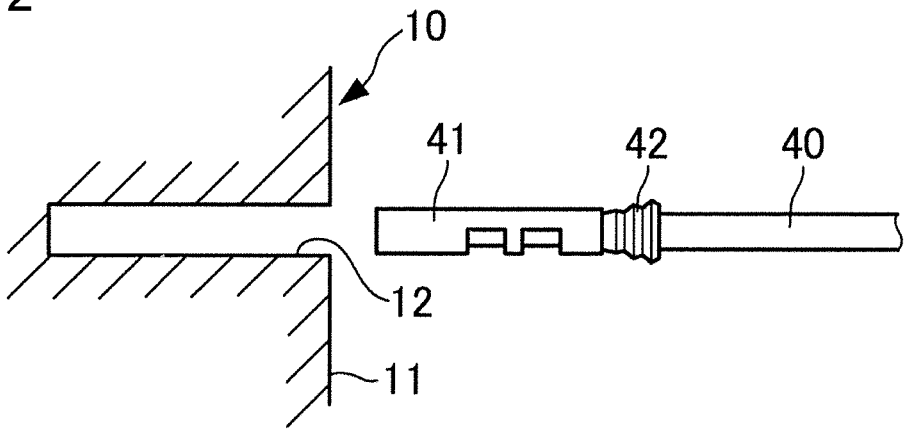
FIG. 2 is a schematic side view of an end part of a wire shown in FIG. 1B.

As shown in FIGS. 1A and 2, the connector housing 10 has a terminal insertion surface 11, and terminal insertion holes 12 are arranged side by side in a width direction of the terminal insertion surface 11. Terminals 41 crimped to end parts of wires 40 are inserted are inserted into the terminal insertion holes. As shown in FIG. 2, a waterproof plug 42 made of rubber is provided from a part of the wire 40 adjacent to one end part of the terminal 41. The waterproof plug 42 is held in close contact with an inner peripheral part of the terminal insertion hole 12 and keeps the interior of the terminal insertion hole 12 watertight when the terminal 41 is inserted into the terminal insertion hole 12.

Figure 3:
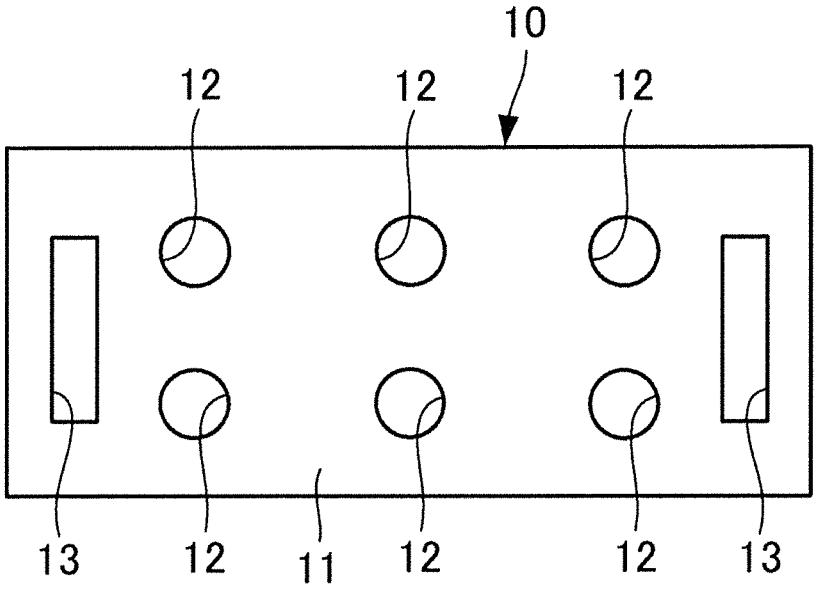
FIG. 3 is a schematic front view of a connector housing in the connector according to the embodiment of the present invention.

The connector housing 10 has a rectangular parallelepipedic shape, as shown in FIGS. 1A and 1B, and a total of six terminal insertion holes 12 are formed on the terminal insertion surface 11, which is one end surface of a rectangular parallelepiped. Rib insertion openings 13 are formed on opposite widthwise end parts of the terminal insertion surface 11, as shown in FIG. 3. Three terminal insertion holes 12 are arranged side by side in the width direction (lateral direction) of the terminal insertion surface 11 and two rows of the terminal insertion holes 12 are arranged in a short side direction (vertical direction) of the terminal insertion surface 11.

Figure 4:
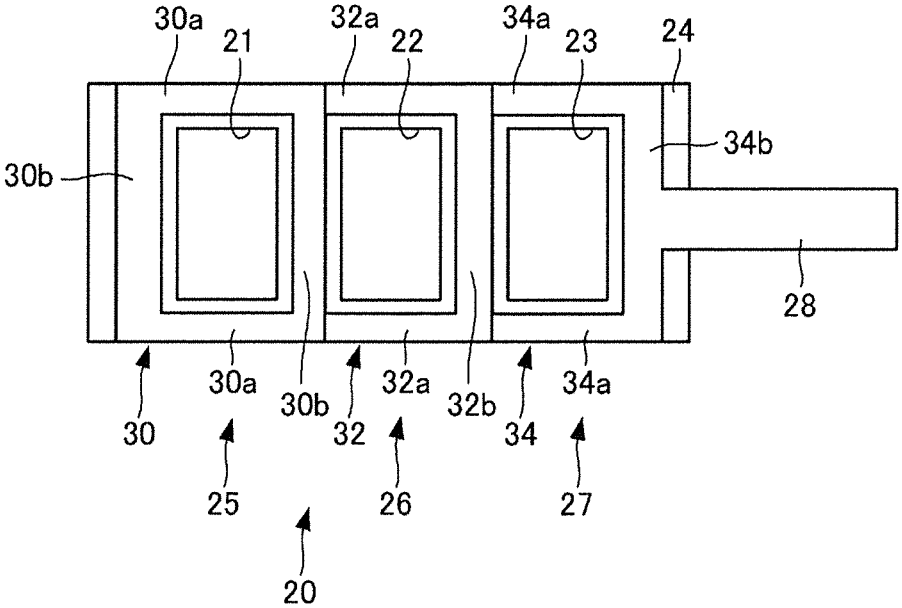
FIG. 4 is a schematic front view of a wire support in the connector according to the embodiment of the present invention.

As shown in FIGS. 1A, 1B and 4, the wire guide 20 includes a support 24, guiding portions 25, 26 and 27 and a supporting rib 28.

Figure 5:
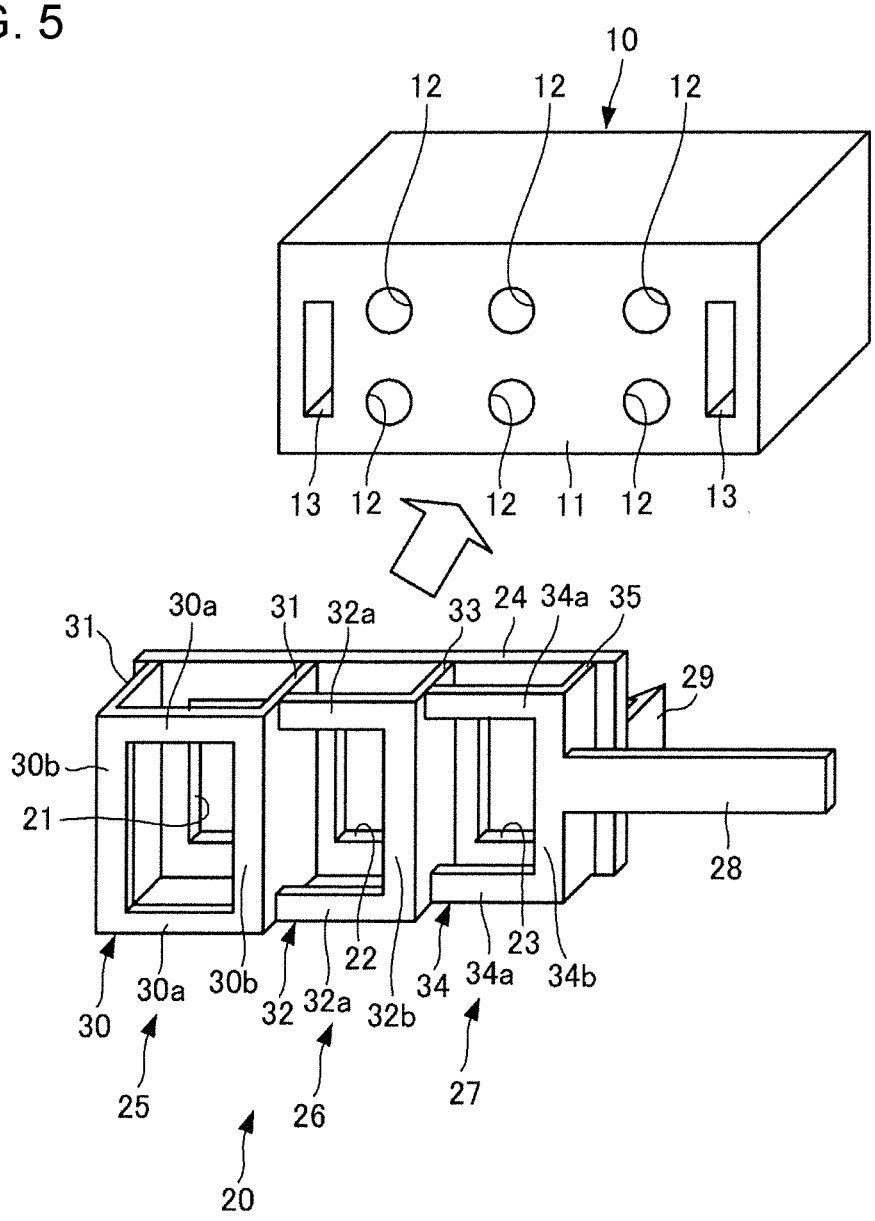
FIG. 5 is a schematic perspective view showing a state where the wire support is mounted on the connector housing in the connector according to the embodiment of the present invention.

As shown in FIGS. 4 and 5, the support 24 is a plate-like member to be brought into contact with the terminal insertion surface part 11 of the connector housing 10. The supporting portion 24 includes three openings 21, 22 and 23 arranged side by side in the lateral direction and fixing ribs 29. The supporting portion 24 is fixed to the connector housing 10 by engaging the fixing ribs 29 with the rib insertion openings 13 of the terminal insertion surface 11 described above.

Figure 6:
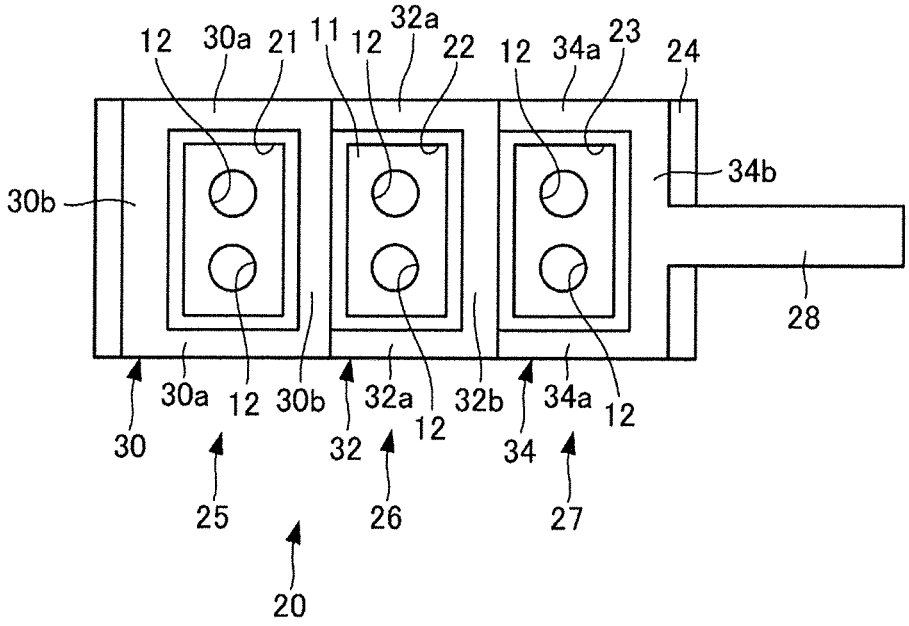
FIG. 6 is a schematic front view of the connector according to the embodiment of the present invention.

As shown in FIG. 6, the three openings 21, 22 and 23 formed on the support 24 respectively expose the terminal insertion holes 12 located on a left side in the width direction of the terminal insertion surface 11, the terminal insertion holes 12 located in a widthwise center and the terminal insertion holes 12 located on a right side in the width direction.

As shown in FIGS. 1A, 1B, 5 and 6, the guiding portions 25, 26 and 27 are provided side by side in the width direction of the terminal insertion surface part 11 in correspondence with the terminal insertion holes 12. Further, the guiding portions 25, 26 and 27 are configured to guide the wires 40 having the terminals 41 inserted into the terminal insertion holes 12 by bending them toward one side in the width direction of the terminal insertion surface 11.

Figure 7:
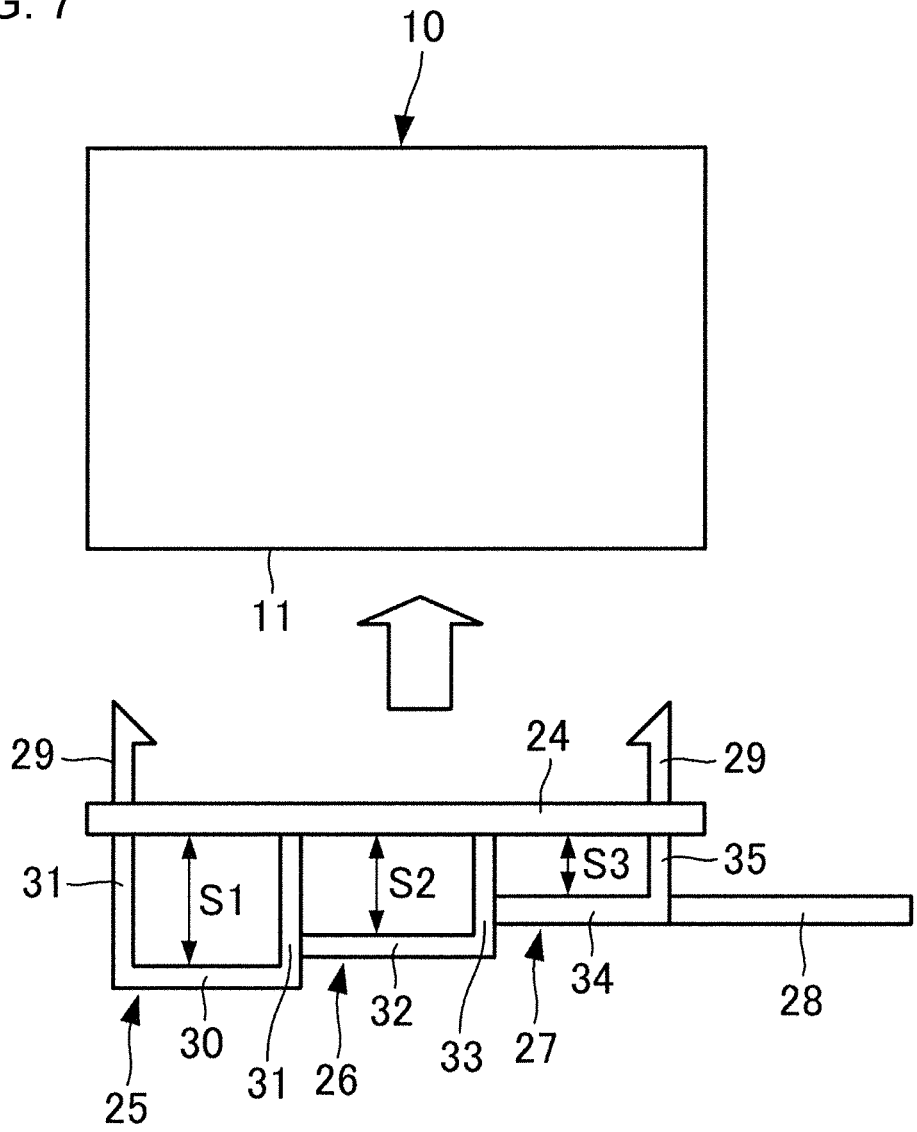
FIG. 7 is a schematic plan view showing the state where the wire support is mounted on the connector housing in the connector according to the embodiment of the present invention.
Figure 8:
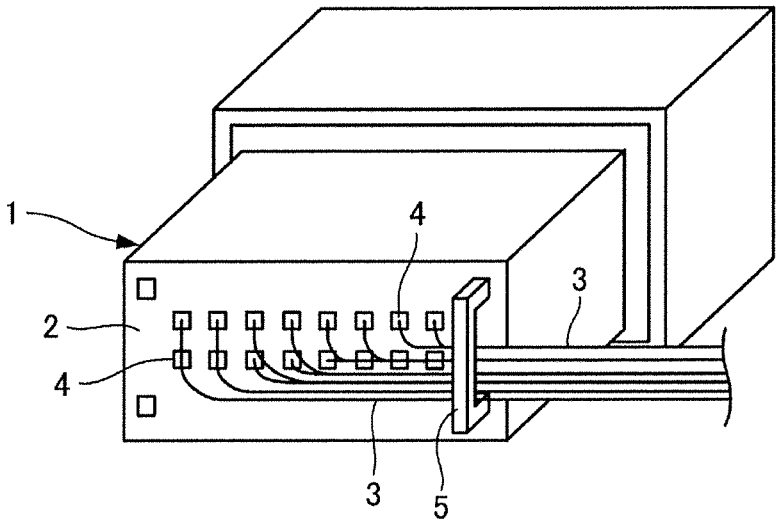
FIG. 8 is a schematic perspective view showing an example of a conventional connector housing.

Further, as shown in FIG. 7, the guiding portions 25, 26 and 27 are configured so that a distance S1, S2, S3 from the terminal insertion surface 11 is shorter for the guiding portion located closer to the one side in the width direction of the terminal insertion surface 11.

The guiding portion 25 includes a rectangular frame 30 composed of upper and lower beams 30*a*, left and right columns 30*b* and facing the opening 21 and two walls 31 supporting the frame 30 on the support 24. The guiding portion 25 also has open upper and lower parts.

The walls 31 are connected to the columns 30*b* of the frame 30 and the support 24 and fix the frame 30 to the supporting portion 24. The frame 30 is at the distance S1 from the support 24.

Further, the column 30*b* located on the right side toward the supporting portion 24 guides the wires 40 having the terminals 41 inserted into the terminal insertion holes 12 via the opening 21 in a laterally extended state by bending them to the right in the width direction of the terminal insertion surface 11.

The guiding portion 26 includes a U-shaped frame 32 composed of upper and lower beams 32*a* and a column 32*b* located on the right side toward the support 24 and facing the opening 22. A wall 33 supports the frame 32 on the support 24, and has open upper and lower parts.

The wall 33 is connected to the column 32*b* of the frame 32 and the support 24 and fixes the frame 32 to the support 24. Left end parts of the beams 32*a* are connected to the wall 31 located on the right side in the guiding portion 25. The frame 32 is at the distance S2 from the supporting portion 24. This distance S2 is shorter than the distance S1 of the frame 30 from the supporting portion 24.

Further, the column 32*b* guides the wires 40 having the terminals 41 inserted into the terminal insertion holes 12 via the opening 22 in a laterally extended state by bending them to the right in the width direction of the terminal insertion surface 11.

The guiding portion 27 includes a U-shaped frame 34 composed of upper and lower beams 34*a* and a column 34*b* located on the right side toward the support 24 and facing the opening 23 and a wall 35 supporting the frame 34 on the support 24. The guiding portion 27 has open upper and lower parts.

The wall 35 is connected to the column 34*b* of the frame 34 and the supporting portion 24 and fixes the frame 34 to the support 24. Left end parts of the beams 34*a* are connected to the wall 33 of the guiding portion 26. The frame 34 is at the distance S3 from the support 24. This distance S3 is shorter than the distance S2 of the frame 32 from the support 24. Thus, the guiding portion 27 has open upper and lower parts.

Further, the column 32*b* guides the wires 40 having the terminals 41 inserted into the terminal insertion holes 12 via the opening 23 in a laterally extended state by bending them to the right in the width direction of the terminal insertion surface 11.

As shown in FIGS. 5 and 6, the supporting rib 28 is connected to be on the same plane as the column 34*b* of the frame 34 and projects to the right in the width direction of the terminal insertion surface 11. As shown in FIG. 1B, the wires 40 are tied to the supporting rib 28 by a band 43.

In producing a wiring harness W according to this embodiment, the fixing ribs 29 are engaged with the rib insertion openings 13 so that the terminal insertion surface 11 and the support 24 come into contact and the wire guide 20 is mounted on the connector housing 10 as shown in FIGS. 1A, 5, 6 and 7. In this way, the connector housing 10 and the wire guide 20 constitute the connector C.

First, end parts of two wires 40 are passed through the frame 34 of the guiding portion 27 and the opening 23 of the support 24 and the terminals 41 of the wires 40 are inserted into the upper and lower terminal insertion holes 12 on the right side in the width direction of the terminal insertion surface part 11. These wires 40 are guided to the right in the width direction of the terminal insertion surface part 11 by being bent on an outer surface side of the column portion 34*b* of the frame 34.

Subsequently, end parts of two wires 40 are passed through the frame 32 of the guiding portion 26 and the opening 22 of the supporting portion 24 and the terminals 41 of the wires 40 are inserted into the upper and lower terminal insertion holes 12 in a central part in the width direction of the terminal insertion surface 11. These wires 40 are guided to the right in the width direction of the terminal insertion surface part 11 by being bent on an outer surface side of the column portion 32*b* of the frame 32. In this way, the two wires 40 laterally extended through the guiding portion 26 are overlapped with the two wires 40 laterally extended through the guiding portion 27.

Subsequently, end parts of two wires 40 are passed through the frame 30 of the guiding portion 25 and the opening 21 of the support 24 and the terminals 41 of the wires 40 are inserted into the upper and lower terminal insertion holes 12 on the left side in the width direction of the terminal insertion surface 11. These wires 40 are guided to the right in the width direction of the terminal insertion surface 11 by being bent on an outer surface side of the right column 30*b* of the frame 30. In this way, the two wires 40 laterally extended through the guiding portion 25 are overlapped with the two wires 40 laterally extended through the guiding portion 26.

Further, a total of six wires 40 guided to the right in the width direction of the terminal insertion surface 11 by the columns 30*b*, 32*b* and 34*b* of the frames 30, 32 and 34 are tied to the supporting rib 28 using the band 43 to constitute the wiring harness W.

In the connector C and the wiring harness W according to this embodiment, if the connector housing 10 is pulled to the left, a bent part of the wire 40 having a shortest extra length comes into contact with the column portion 30*b*, 32*b*, 34*b* of the frame 30, 32, 34 corresponding to the wire 40.

If the bent part of the wire 40 comes into contact with the column 30*b* of the frame 30, a stress acts on the guiding portion 25. If the bent part of the wire 40 comes into contact with the column 32*b* of the frame 32, a stress acts on the guiding portion 26. If the bent part of the wire 40 comes into contact with the column 34*b* of the frame 34, a stress acts on the guiding portion 25. Thus, no tension is applied to a terminal crimping portion of the wire 40 in the laterally extended state in a direction oblique to the terminal 41, and the waterproof plug 42 is not deformed.

Thus, the connector C and the wiring harness W according to this embodiment can prevent the breakage of the wires 40 near the terminal crimping portions and keep the interiors of the terminal insertion holes 12 in a watertight manner.

In the connector C and the wiring harness W according to this embodiment, the distance from the terminal insertion surface part 11 is shorter for the guiding portion 25, 26, 27 closer to the side toward which the wires 40 are laterally extended. Thus, the plurality of wires 40 laterally extended from the guiding portions 25, 26 and 27 can be overlapped effortlessly and a variation in the extra lengths of these wires 40 can be suppressed.

In the connector C and the wiring harness W according to this embodiment, the upper and lower parts of the guiding portions 25, 26 and 27 are open. Thus, it is possible to easily insert the terminals 41 into the terminal insertion holes 12 of the terminal insertion surface part 11 while visually confirming the wires 40 passed through the frames 30, 32 and 34.

In the embodiment described above, the wire guide 20 is mounted on the connector housing 10 so that the supporting rib 28 projects to the right in the width direction of the terminal insertion surface part 11. Instead of this, the wire guide 20 may be inverted vertically and so mounted on the connector housing 10 that the supporting rib 28 projects to the left in the width direction of the terminal insertion surface part 11.

As described above, in the connector and the wiring harness according to the invention, if the connector housing is pulled in a direction opposite to the extended direction of the wires, the bent part of the wire having a shortest extra length comes into contact with the guiding portion and a stress acts on the guiding portion. Thus, in the connector and the wiring harness according to the present invention, no tension is applied to the terminal crimping portion of the wire in the laterally extended state in a direction oblique to the axis of the terminal. Therefore an effect of preventing the breakage of the wire can be exhibited.

Since no tension is applied to the terminal crimping portion of the wire in the laterally extended state in the direction oblique to the axis of the terminal, the connector and the wiring harness according to the present invention can be applied to vehicles, various devices, machine equipment and the like.

LIST OF REFERENCE SIGNS

C connector
W wiring harness
10 connector housing
11 terminal insertion surface
12 terminal insertion hole
25 guiding portion
26 guiding portion
27 guiding portion
40 wire
41 terminal
S1 distance
S2 distance
S3 distance

The invention claimed is:

1. A connector formed such that a plurality of terminal insertion holes, into which terminals crimped to end parts of wires are inserted, are arranged side by side in a width direction of a terminal insertion surface on the terminal insertion surface part of a connector housing, comprising:

a plurality of guiding portions provided side by side in the width direction of the terminal insertion surface in correspondence with the plurality of terminal insertion holes, wherein:

the plurality of guiding portions include a plurality of frames at specified distances from the terminal insertion surface part;

the plurality of frames guide the wires having the terminals inserted into the terminal insertion holes in a perpendicular direction until the wires are separated from the terminal insertion surface part by specified distances and are provided so that a distance from the terminal insertion surface is shorter for the frame closer to a side toward which the wires are laterally extended; and the frame closest to the side toward which the wires are laterally extended includes a supporting rib extending in a laterally extended direction from the frame, supporting the plurality of wires in contact and fixed together with the plurality of wires by a band.

2. A wiring harness, comprising:

the connector of claim 1; and wires having terminals inserted into the terminal insertion holes of the connector housing.

* * * * *